US006208095B1

(12) United States Patent
DiVergilio et al.

(10) Patent No.: US 6,208,095 B1
(45) Date of Patent: Mar. 27, 2001

(54) COMPACT HELICAL RESONATOR COIL FOR ION IMPLANTER LINEAR ACCELERATOR

(75) Inventors: William F. DiVergilio, Beverly; Kourosh Saadatmand, Merrimac; Stephen M. Quinn, Gloucester, all of MA (US)

(73) Assignee: Axcelis Technologies, Inc., Beverly, MA (US)

( * ) Notice: Subject to any disclaimer, the term of this patent is extended or adjusted under 35 U.S.C. 154(b) by 0 days.

(21) Appl. No.: 09/219,686

(22) Filed: Dec. 23, 1998

(51) Int. Cl.[7] ..... H01P 7/00; H01P 1/208

(52) U.S. Cl. ..... 315/505; 250/492.21; 333/202; 333/219

(58) Field of Search ..... 315/505; 250/492.21; 333/202, 219

(56) References Cited

U.S. PATENT DOCUMENTS

| | | | | |
|---|---|---|---|---|
| 4,700,158 | * | 10/1987 | Dorsey | 333/202 |
| 5,344,815 | | 9/1994 | Su et al. | 505/1 |
| 5,351,023 | | 9/1994 | Niiranen | 333/202 |
| 5,418,508 | * | 5/1995 | Puurunen | 333/202 |
| 5,445,153 | | 8/1995 | Sugie et al. | 128/653.5 |
| 5,546,743 | | 8/1996 | Conner | 60/202 |

* cited by examiner

*Primary Examiner*—Teresa M. Arroyo
*Assistant Examiner*—Nikita Wells
(74) *Attorney, Agent, or Firm*—John A. Kastelic

(57) ABSTRACT

A compact coil design is provided for a linear accelerator resonator (70) capable of resonating at a predetermined frequency. The coil (90) comprises a plurality of generally circular coil segments **(90*a*–90*n*), each of the coil segments having a polygonal cross section wherein flat surfaces (122) of adjacent coil segments face each other. The polygonal cross section may take the form of a rectangle having dimensions of length x and width y, wherein dimension x section defines the flat surfaces (122) of adjacent coil segments (90*a*–90*n*). The coil segments (90*a*–90*n*) are provided with a dual channel construction for providing the introduction of a cooling medium into the coil. The dual channel construction comprises an inlet passageway (118) and an outlet passageway (120) having separate a separate inlet (100) and outlet (102), respectively, at a first end (94) of the coil, and wherein the inlet and outlet passageways (118, 120) are connected and in communication with each other at a second end (96)** of the coil.

13 Claims, 8 Drawing Sheets

COMPACT HELICAL RESONATOR COIL FOR ION IMPLANTER LINEAR ACCELERATOR

FIELD OF THE INVENTION

The present invention relates generally to high-energy ion implantation systems and more particularly to a compact helical resonator coil for use in a linear accelerator in such systems.

BACKGROUND OF THE INVENTION

Ion implantation has become the technology preferred by industry to dope semiconductors with impurities in the large-scale manufacture of integrated circuits. High-energy ion implanters are used for deep implants into a substrate. Such deep implants are required to create, for example, retrograde wells. Eaton GSD/HE and GSD/VHE ion implanters are examples of such high-energy implanters. These implanters can provide ion beams at energy levels up to 5 MeV (million electron volts). U.S. Pat. No. 4,667,111, assigned to the assignee of the present invention, Eaton Corporation, and describing such an high-energy ion implanter, is incorporated by reference herein as if fully set forth.

A block diagram of a typical high-energy ion implanter 10 is shown in FIG. 1. The implanter 10 comprises three sections or subsystems: a terminal 12 including an ion source 14 powered by a high-voltage supply 16 to produce an ion beam 17 of desired current and energy; an end station 18 which contains a rotating disc 20 carrying wafers W to be implanted by the ion beam; and a beamline assembly 22, located between the terminal 12 and the end station 18, which contains a mass analysis magnet 24 and a radio frequency (RF) linear accelerator (linac) 26. A final energy magnet (not shown in FIG. 1) may be positioned between the linac 26 and the rotating disc.

The RF linac 26 comprises a series of resonator modules 30*a* through 30*n*, each of which functions to further accelerate ions beyond the energies they achieve from a previous module. FIG. 2 shows a known type of resonator module 30, comprising a large inductive coil L having a circular cross section and being contained within a resonator cavity housing 31 (i.e., a "tank" circuit). A radio frequency (RF) signal is capacitively coupled to a high-voltage end of the inductor L via capacitor $C_c$. An accelerating electrode 32 is directly coupled to the high-voltage end of the inductor L. Each accelerating electrode 32 is mounted between two grounded electrodes 34 and 36, and separated by gaps 38 and 40, respectively.

FIG. 3 shows a simple lumped parameter equivalent circuit for the resonator geometry of FIG. 2. The capacitance C includes the capacitance of the high voltage electrode with respect to ground, the stray capacitance of the coil and electrode stem with respect to ground, and the inter-turn coil capacitance.

Values for C and L are chosen for the circuit to achieve a state of resonance so that a sinusoidal voltage of large amplitude may be achieved at the accelerating electrode 32. The accelerating electrode 32 and the ground electrodes 34 and 36 operate in a known "push-pull" manner to accelerate the ion beam passing therethrough, which has been "bunched" into "packets". During the negative half cycle of the RF sinusoidal electrode voltage, a positively charged ion packet is accelerated (pulled by the accelerating electrode 32) from the first grounded electrode 34 across gap 38. At the transition point in the sinusoidal cycle, wherein the electrode 32 is neutral, the packet drifts through the electrode 32 (also referred to as a "drift tube") at constant velocity.

During the positive half cycle of the RF sinusoidal electrode voltage, positively charged ion packets are further accelerated (pushed by the accelerating electrode 32) toward the second grounded electrode 36 across gap 40. This push-pull acceleration mechanism is repeated at subsequent resonator modules having accelerating electrodes that also oscillate at a high-voltage radio frequency, thereby further accelerating the ion beam packets by adding energy thereto. The RF phase of successive accelerating electrodes in the modules is independently adjusted to insure that each packet of ions arrives at the appropriate gap at a time in the RF cycle that will achieve maximum acceleration.

Referring to FIG. 3, it is convenient for analysis to replace the three circuit values R, L and C by the parameters ω (the resonant frequency), Q (the quality factor), and Z (the characteristic impedance), where: $\omega=(LC)^{-1/2}$, $Q=R/(\omega L)$, and $Z=\omega L=1/(\omega C)=(LC)^{1/2}$. Note that ω is the radial frequency, equal to 2 π times the conventional frequency (Hertz).

To minimize the power required to obtain a given electrode voltage, the product of the quality factor Q and the characteristic impedance Z must be maximized. Prior art resonators such as that shown in FIG. 4 are designed using known design principles for high Q resonators. Such designs utilize a circular cross section conductor for the coil. By utilizing a rectangular cross section conductor, as is contemplated by the present invention, with the short dimension parallel to the coil axis 47, higher impedance coils may be realized while still maintaining a high quality factor Q. The shorter conductor dimension parallel to the coil axis allows smaller winding pitch, i.e., a shorter coil, which has less capacitance with respect to ground (the resonator housing 31). Thus, the ratio of the coil inductance to the coil capacitance is increased.

SUMMARY OF THE INVENTION

A compact coil design is provided for a linear accelerator resonator capable of resonating at a predetermined frequency. The coil comprises a plurality of generally circular coil segments, each of the coil segments having a polygonal cross section wherein flat surfaces of adjacent coil segments face each other. The polygonal cross section may take the form of a rectangle having dimensions of length x and width y, wherein dimension x section defines the flat surfaces of adjacent coil segments. The coil segments are provided with a dual channel construction for providing the introduction of a cooling medium into the coil. The dual channel construction comprises an inlet passageway and an outlet passageway having a separate inlet and outlet, respectively, at a first end of the coil, and wherein the inlet and outlet passageways are connected and in communication with each other at a second end of the coil.

DETAILED DESCRIPTION OF A PREFERRED EMBODIMENT OF THE INVENTION

Figure 5:
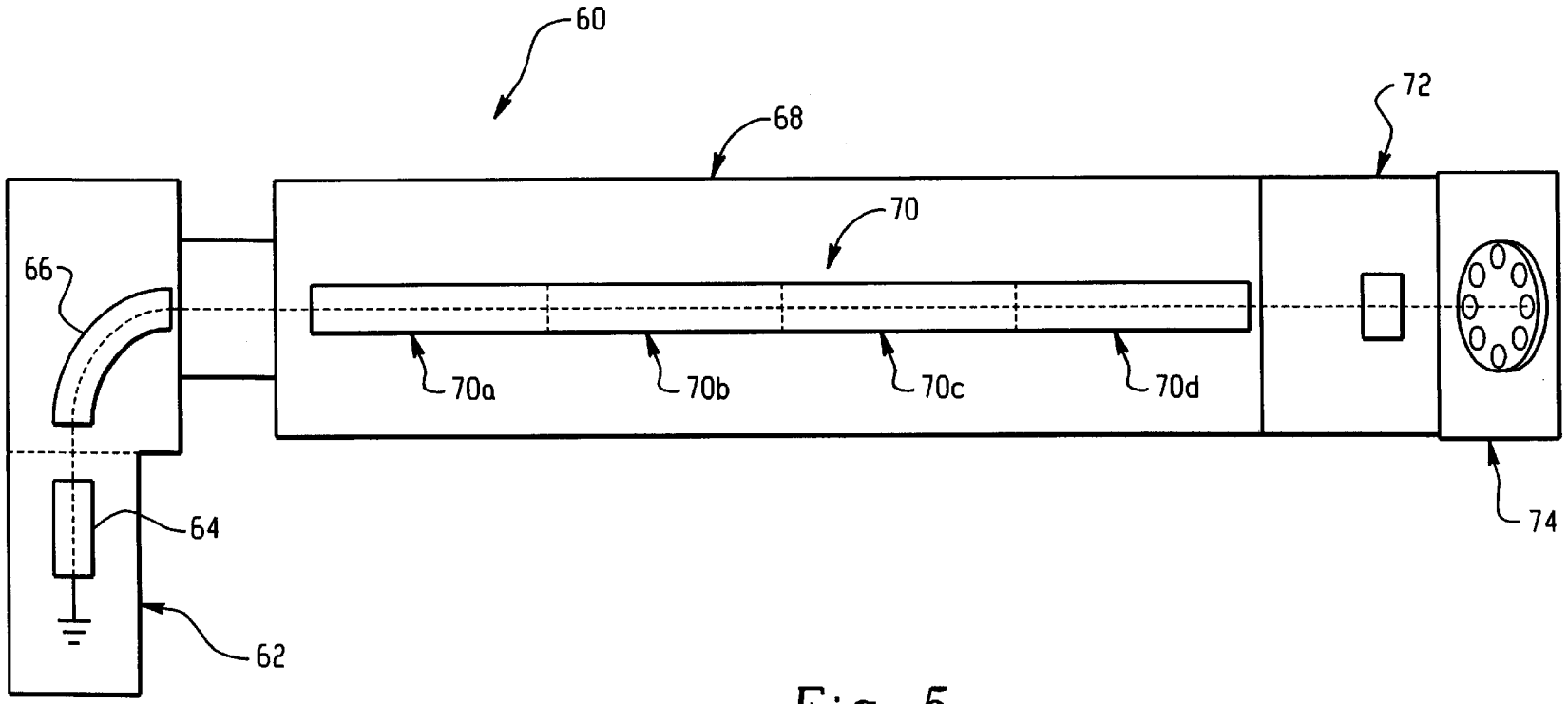
FIG. 5 is a cross sectional plan view of an ion implanter having a linear accelerator including a resonator coil assembly constructed according to the principles of the present invention.

Referring to FIG. 5, a cross sectional plan view of a high-energy ion implanter 60 is shown. The implanter 60 comprises three sections or subsystems: a terminal 62 including an ion beam-generating ion source 64 and a mass analysis magnet 66; a radio frequency (RF) linear accelerator (linac) 68 comprising a plurality of resonator modules 70, a final energy magnet (FEM) 72; and an end station 74 which typically contains a rotating disc carrying wafers to be implanted by the ion beam.

The mass analysis magnet 66 functions to pass to the RF linac 68 only the ions generated by the ion source 64 having an appropriate charge-to-mass ratio. The mass analysis magnet is required because the ion source 64, in addition to generating ions of appropriate charge-to-mass ratio, also generates ions of greater or lesser charge-to-mass ratio than that desired. Ions having inappropriate charge-to-mass ratios are not suitable for implantation into the wafer.

The ion beam that passes through the mass analysis magnet 66 enters the RF linac 68 which imparts additional energy to the ion beam passing therethrough. The RF linac produces particle accelerating fields which vary periodically with time, the phase of which may be adjusted to accommodate different atomic number particles as well as particles having different speeds. The RF linac 68 comprises a series of resonator modules 70*a*–70*d*, each of which functions to further accelerate ions beyond the energies they achieve from a previous module.

Figure 6:
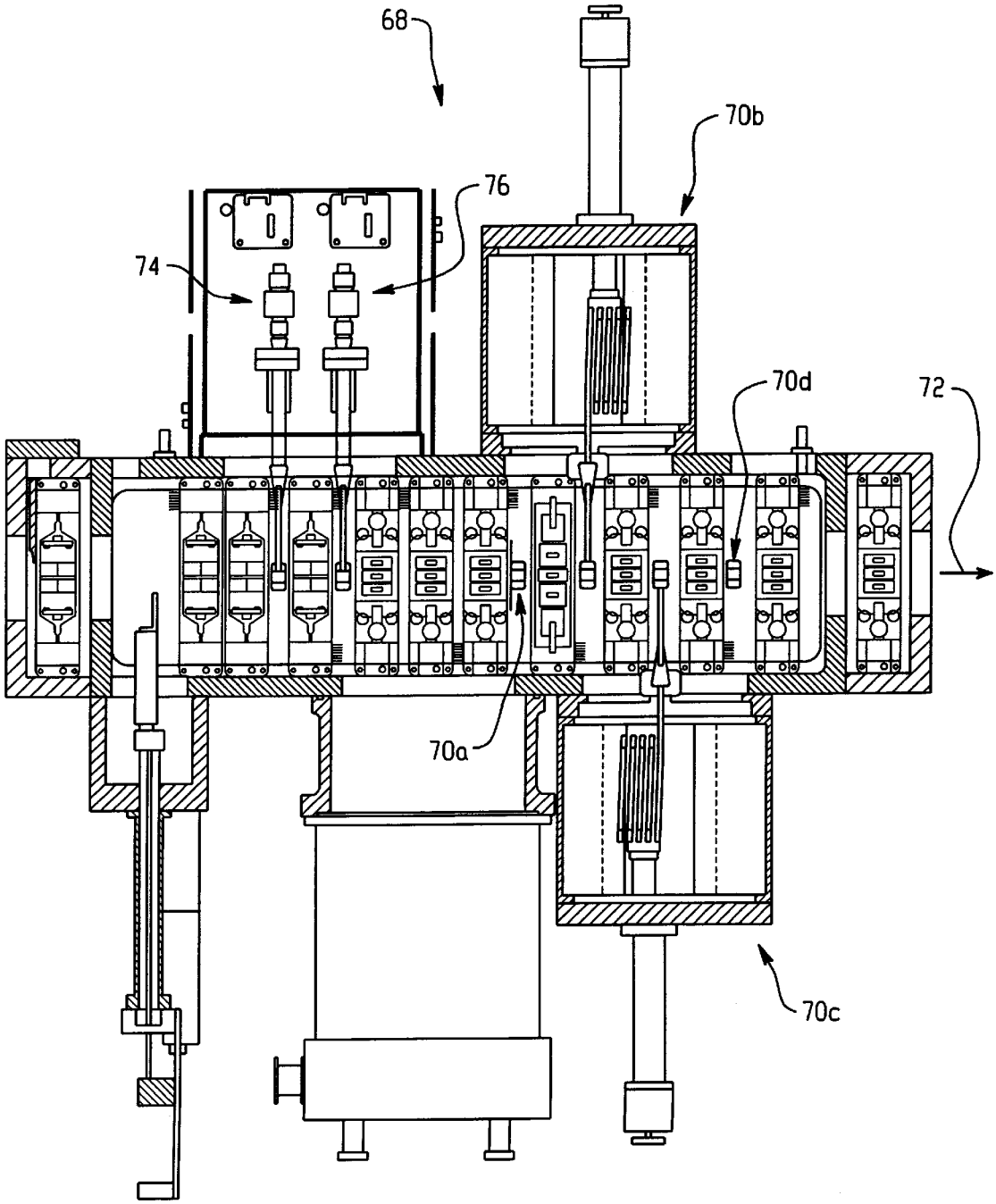
FIG. 6 is an enlarged cross sectional plan view of the linear accelerator of the ion implanter of FIG. 5.

FIG. 6 shows an enlarged cross sectional plan view of the RF linac 68 shown in FIG. 5. As shown in FIG. 6, this RF linac 68 includes four resonator modules 70*a*–70*d*, only two of which, 70*b* and 70*c*, are fully shown. The ion beam is accelerated through the RF linac 68 and exits at the location and in the direction of arrow 72. Upstream of the four resonator modules 70*a*–70*d* are "bunching" resonators 74 and 76 which bunch the ions into packets.

Figure 7:
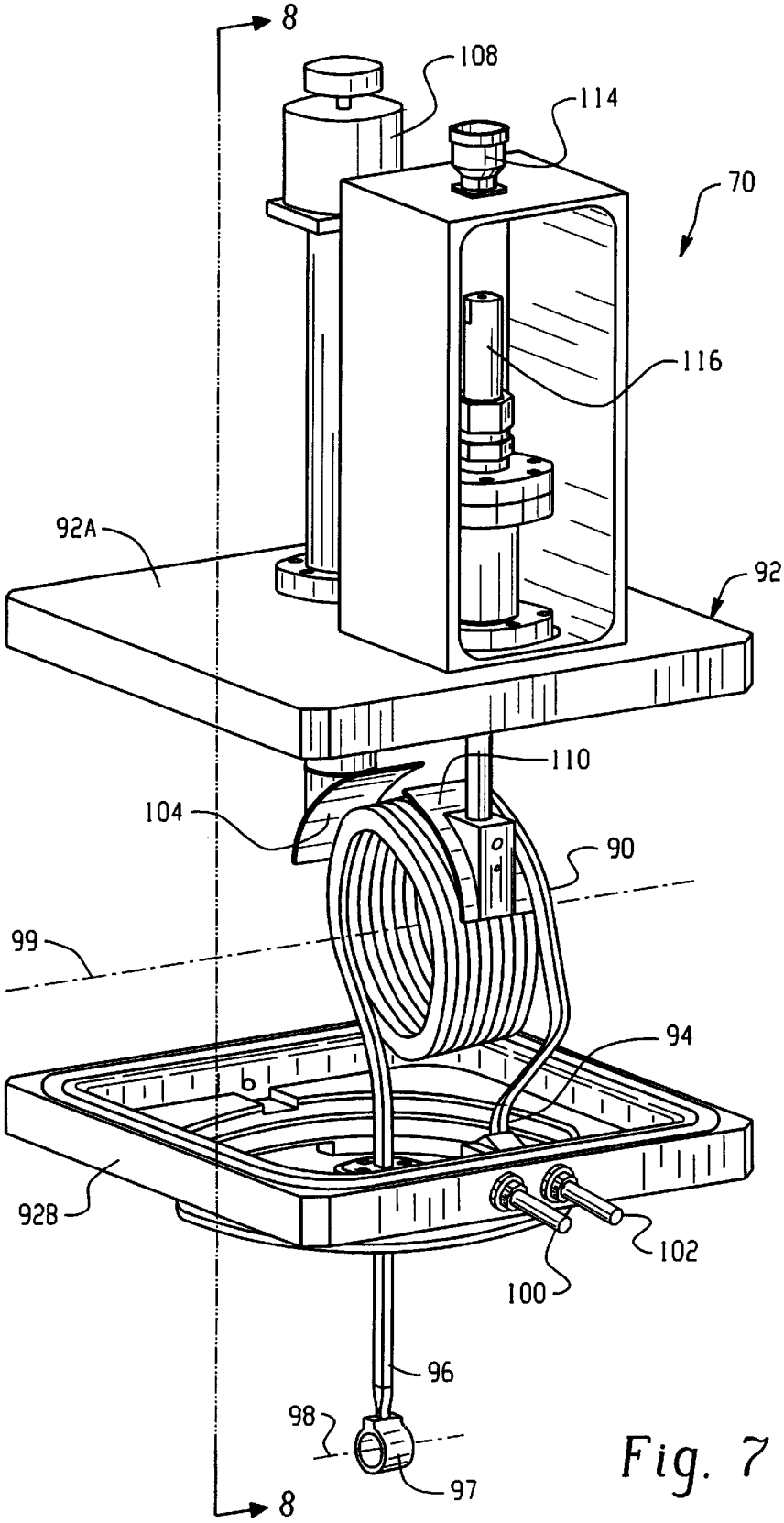
FIG. 7 is a perspective view of one of the four resonator modules shown in the linear accelerator of FIG. 6.
Figure 8:
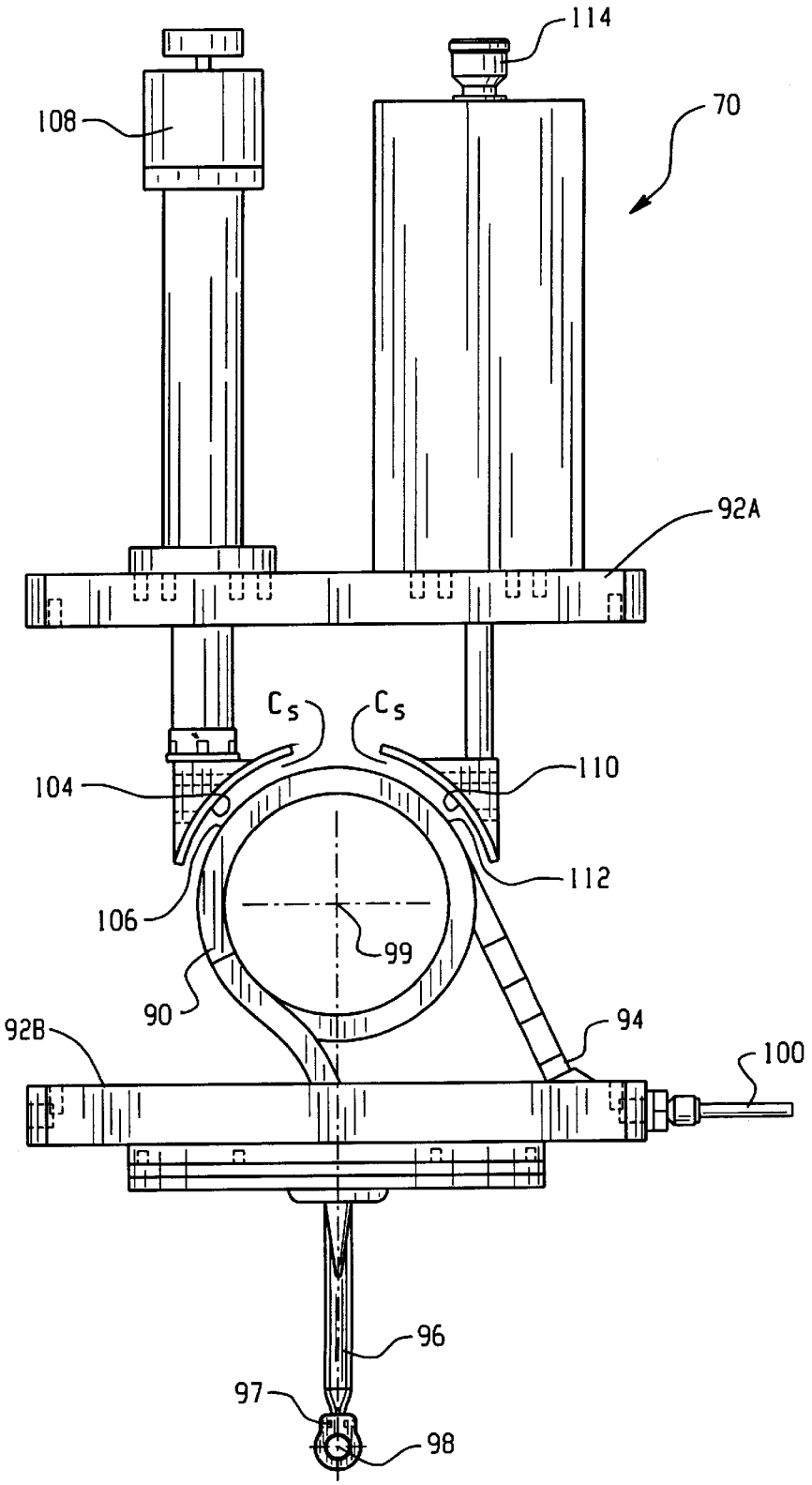
FIG. 8 is a cross sectional view of the resonator module shown in FIG. 7 taken along the line 8—8.

FIGS. 7 and 8 show in greater detail one of the four resonator modules 70 shown in the RF linac of FIG. 6. Each resonator module 70 comprises a inductor coil 90 of inductance L contained within an electrically grounded resonator aluminum shield or housing 92, and having an non-circular (e.g., polygonal) cross section (see FIGS. 10 and 10A). The housing 92 includes an upper plate 92A, a lower plate 92B, and a duct (not shown) extending between the upper and lower plates to complete the enclosure. The coil 90 forms a compact, generally cylindrical shape having an electrically grounded first end 94 that terminates in the lower housing plate 92B, and a second end 96 that extends outside of the housing 92 and terminates in a cylindrical aluminum, high-voltage electrode or drift tube 97. An axis 98 of the drift tube 97 is parallel to an axis 99 of the cylindrical coil 90.

As further explained below with respect to FIGS. 10 and 10A, the inductor coil 92 is comprised of copper and provides internal dual channel means for circulating cooling water through its interior. The cooling water is provided through coil inlet 100 and exits the coil through outlet 102. Internally water cooling the coil helps dissipate heat generated by electrical current flowing therethrough.

The resonator module 70 of the present invention provides improved tuning and matching mechanisms. The tuning mechanism is provided in the form of a tuning capacitor $C_S$ formed by a copper, electrically grounded, arcuate plate 104 and a corresponding portion 106 of the copper coil 90, with air in the space therebetween acting as the dielectric. The tuning mechanism provided by the arcuate plate 104 provides tuning of the resonator without stretching or compressing the coil along its axis 99.

As the arcuate plate 104 is moved toward the coil 90, the total stray capacitance $C_S$ of the resonator (see FIG. 2) decreases, thereby increasing the resonant frequency of the resonator 70. Conversely, as the arcuate plate 104 is moved away from the coil 90, the capacitance $C_S$ of the resonator increases, thereby decreasing the resonant frequency of the resonator 70. In this manner, to maintain a state of resonance for the resonator 70, the product of $L \times C_S$ is maintained constant by altering $C_S$ to accommodate drifts in $C_S$ and changes in L during operation.

A linear drive mechanism 108 is provided for bidirectionally moving the arcuate plate 104 toward and away from the coil 90. A tuning servomotor (not shown) functions to operate the linear drive mechanism 108. The tuning servomotor is part of a tuning control loop (not shown) that receives an error signal from the resonator phase control circuit to correct for drift in the resonance frequency of the resonator, in much the same manner as the coil stretching/compressing servomotor functioned in the prior art. The tuning control loop may include a linear position encoder to provide feedback for the position of the arcuate plate 104.

The matching mechanism for the resonator 70 is provided in the form of a matching capacitor $C_C$ formed by a copper, arcuate plate 110 and a corresponding portion 112 of the copper coil 90, with air in the space therebetween acting as the dielectric. An RF signal is thereby capacitively coupled to the coil via connector 114, RF slidable coupling rod 116, and capacitor $C_C$. The capacitor $C_C$ functions as a transformer to match the impedance of the RF source (typically 50 Ω) with the impedance of the circuit $R_L$ (typically 1MΩ) to minimize reflection of the input signal from the circuit back into the source. The arcuate plate 110 may be moved toward or away from the coil 90 to decrease or increase, respectively, the capacitance of capacitor $C_C$. By capacitively coupling the RF signal to the coil 90 at the location shown in FIGS. 7 and 8, the risk of arcing between the capacitor $C_C$ and the high-voltage end 96 of the coil is significantly reduced.

Figure 9:
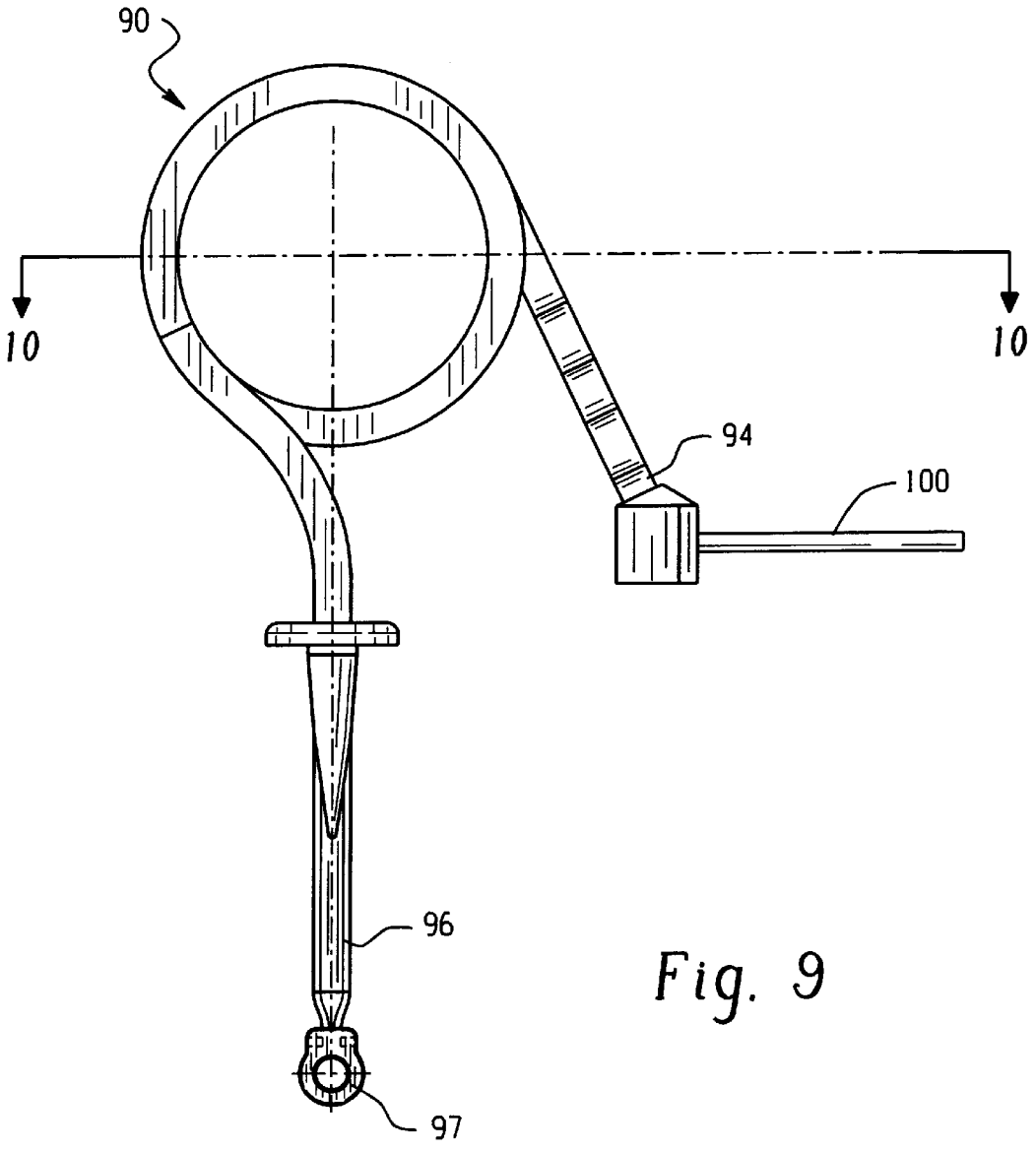
FIG. 9 shows only the coil of the resonator module of FIG. 8.
Figure 10:
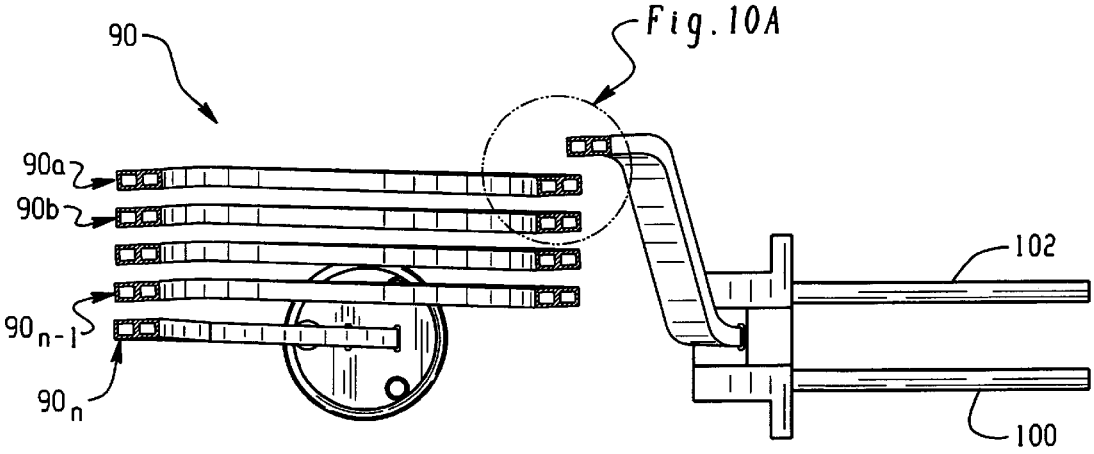
FIG. 10 is a sectional view of the coil of FIG. 9 taken along the lines 10—10.

FIG. 9 shows only the coil 90 of FIG. 8, and FIG. 10 shows a sectional view of the coil taken along the lines 10—10 of FIG. 9. The resonator 70 is designed to resonate at a frequency of 13.56 megahertz (MHz) or 27.12 MHz. At resonance, a voltage on the order of 80,000 volts (80 KV) is generated by the resonator at the accelerator electrode 97. Because generation of such a high voltage requires that a high current that pass through the coil, heat is generated during operation of the resonator. As such, water cooling means are provided in the present invention for cooling the resonator coil.

Figure 10A:
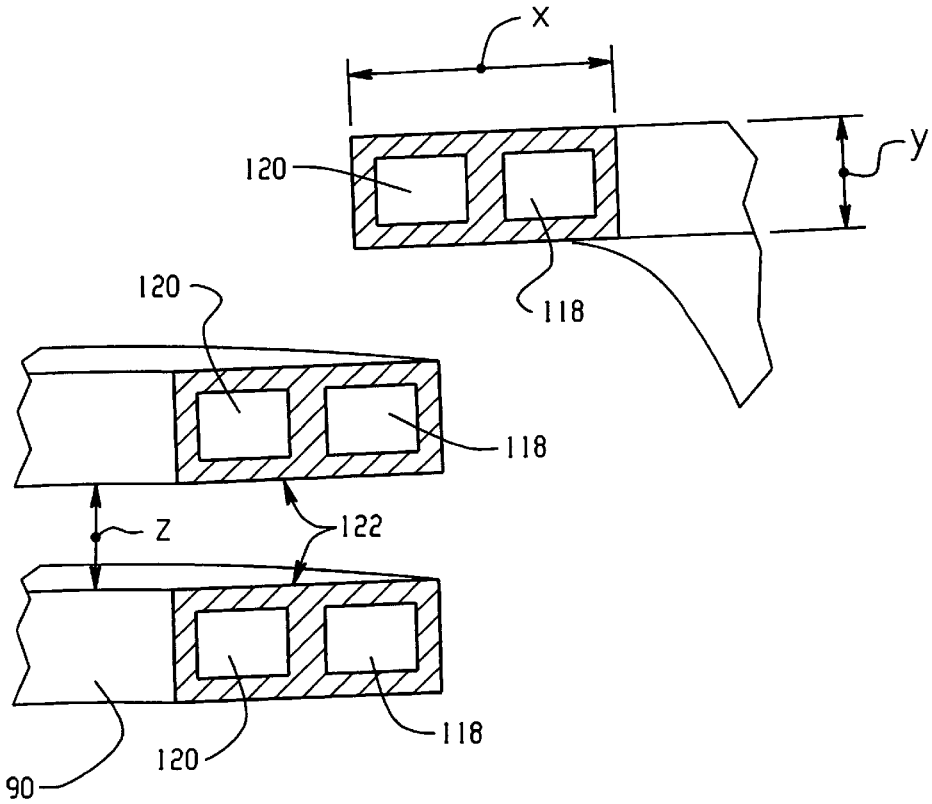
FIG. 10A is an expanded view of a portion of the cross sectional view of the coil of FIG. 10.

As shown in FIG. 10A, the coil 90 has a dual channel construction with an inlet passageway 118 connected directly to the coil inlet 100 and an outlet passageway 120 connected directly to the coil outlet 102. At the high-voltage end 96 of the coil 90, the inlet and outlet passageways 118, 120 meet and communicate at a junction (not shown) so that a continuous flow pattern of a cooling medium, such as water, may be established. In this manner, water introduced into the inlet passageway 118 via coil inlet 100 can pass through the junction and out of the coil via outlet passageway 120 and coil outlet 102.

Figure 1:
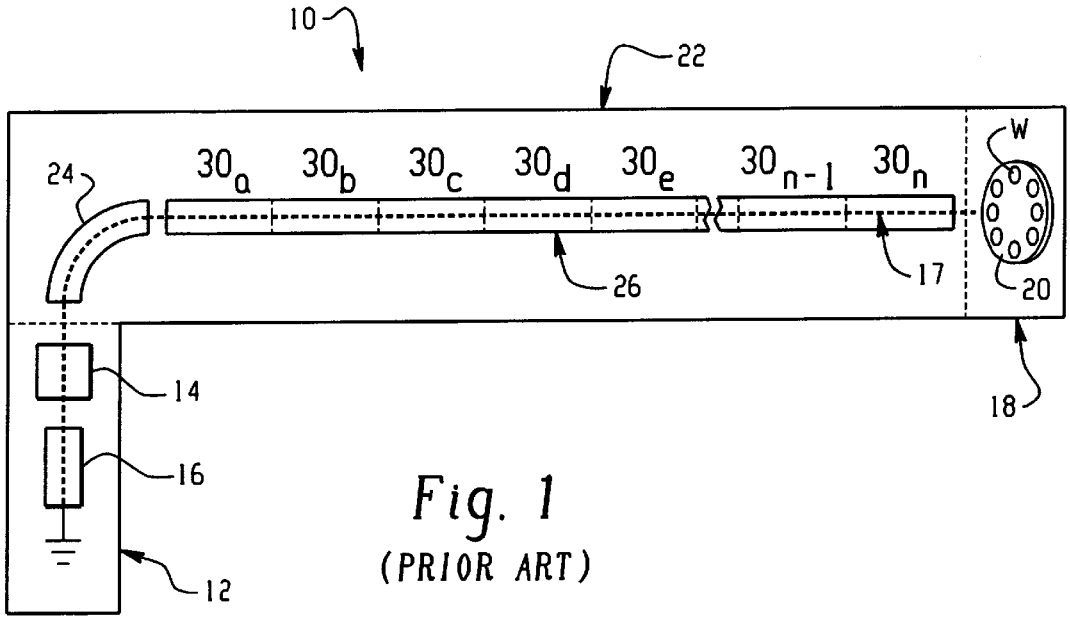
Fig. 1 (PRIOR ART)
FIG. 1 is a schematic block diagram of a prior art ion implanter having a linear accelerator including a resonator coil assembly.
Figure 2:
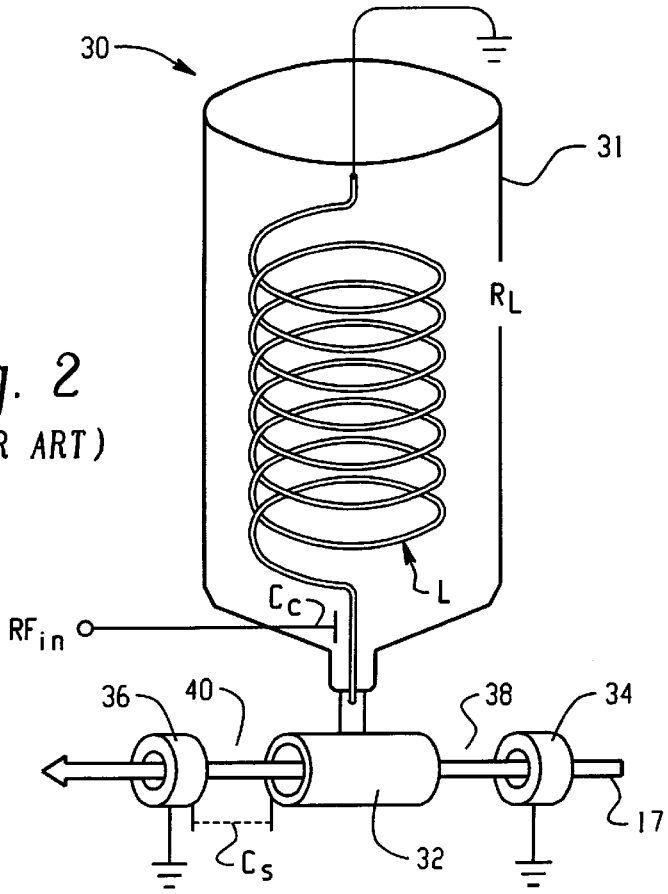
Fig. 2 (PRIOR ART)
FIG. 2 is shows a prior art resonator coil assembly used in an ion implanter such as that of FIG. 1.
Figure 3:
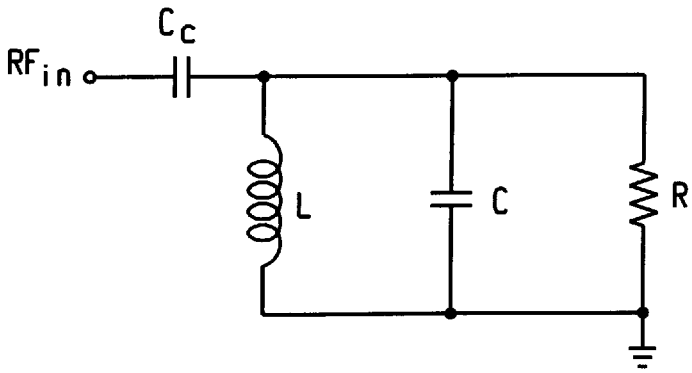
Fig. 3 (PRIOR ART)
FIG. 3 is a schematic diagram of the prior art resonator coil assembly of FIG. 2.
Figure 4:
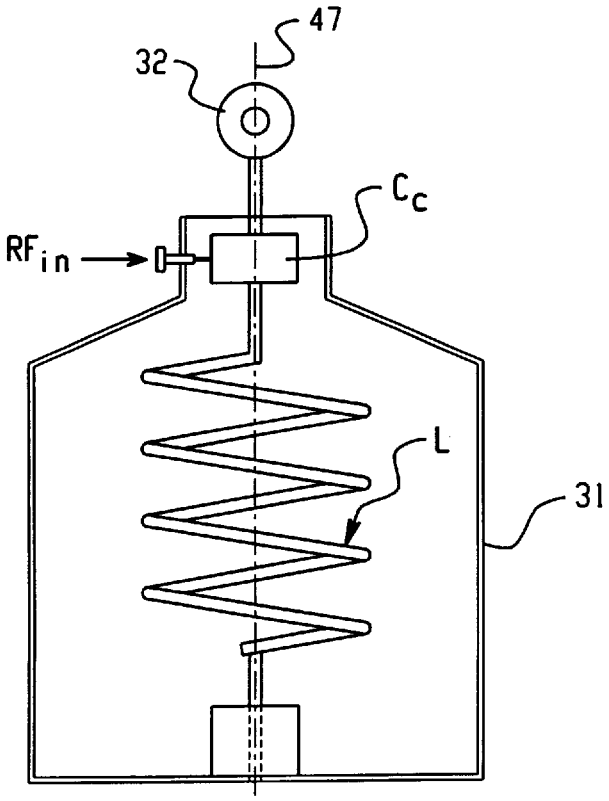
Fig. 4 (PRIOR ART)
FIG. 4 is a cross sectional view of a prior art resonator coil assembly of the type shown in FIG. 2.

As shown in FIG. 10A, the cross section of the coil is a rectangle of dimensions length x and width y. In one preferred embodiment, x=0.5 centimeter (cm); y=2.4 cm; and the distance z separating the individual coil segments 90*a*–90*n*=0.5 cm. The dimension x of the cross section defines flat surfaces 122 of the individual adjacent coil segments 90*a*–90*n* of the coil 90 that face each other. Thus, the current carried by the coil will be distributed over these flat surfaces 122 instead of being concentrated on the tangential portions of a coil of circular cross section as shown in FIG. 2. As such, the cross section of the coil segments 90*a*–90*n* may be of any type of polygon having flat surfaces 122, such as a square. However, by making the rectangular cross section wherein the length x is greater than the width y, the coils may be more closely compressed, thereby increasing the complex impedance $Z(\omega)$, without decreasing the quality factor Q of the resonator.

Thus, a more compact coil design is achieved while providing a resonator of high quality factor Q and efficiency, with lower power losses than previous resonators. As compared to a coil having a circular cross section, the design of the present invention permits a smaller winding pitch (i.e., more coil segments), and therefore a higher conductance, per coil unit length. The resulting shorter coil design exhibits less capacitance to ground. Less capacitance and higher conductance result in a resonator having a higher impedance. Such a high impedance design is particularly important in the case of HE implanters operating at higher frequencies, e.g., $\omega$=27.12 MHz and above, wherein power losses are greater and efficiency is lower than with 13.56 MHz implanters.

Accordingly, a preferred embodiment of an improved compact resonator for an ion implanter linac has been described. With the foregoing description in mind, however, it is understood that this description is made only by way of example, that the invention is not limited to the particular embodiments described herein, and that various rearrangements, modifications, and substitutions may be implemented with respect to the foregoing description without departing from the scope of the invention as defined by the following claims and their equivalents.

What is claimed is:

1. A resonator (70) for resonating at a predetermined frequency in a linear accelerator (68), comprising:

(i) a fixed position inductive coil (90) having a longitudinal axis (99), said coil having a first low-voltage end (94) and second high-voltage end (96);

(ii) a radio frequency (RF) input coupled to said inductive coil;

(iii) a capacitor ($C_S$) electrically connected in parallel with said inductive coil; and (iv) a cylindrical drift tube (97) having a longitudinal axis (98) and being located at the high-voltage end (96) of the coil (90), said longitudinal axis (98) of said drift tube and said longitudinal axis (99) of said coil (90) being oriented substantially parallel to each other.

2. The resonator (70) of claim 1, wherein said low voltage end (94) is electrically grounded.

3. The resonator (70) of claim 1, wherein said RF input is capacitively coupled to the inductive coil (90) through a second capacitor ($C_C$).

4. The resonator (70) of claim 1, wherein said predetermined frequency is at least 27 megahertz (MHz).

5. The resonator (70) of claim 1, wherein said coil (90) is comprised of copper.

6. A resonator (70) for resonating at a predetermined frequency in a linear accelerator (68), comprising:

(i) an inductive coil (90) having a longitudinal axis (99), said coil having a first low-voltage end (94) and a second high-voltage end (96);

(ii) a radio frequency (RF) input coupled to said inductive coil;

(iii) a capacitor (Cs) electrically connected in parallel with said inductive coil; and (iv) a drift tube (97) having a longitudinal axis (98) and being located at the high-voltage end (96) of the coil (90), said longitudinal axis (98) of said drift tube and said longitudinal axis (99) of said coil (90) being oriented substantially parallel to each other.

7. The resonator (70) of claim 6, wherein said low voltage end (94) is electrically grounded.

8. The resonator (70) of claim 6, wherein said RF input is capacitively coupled to the inductive coil (90) through a second capacitor (Cc).

9. The resonator (70) of claim 6, wherein said predetermined frequency is at least 27 megahertz (MHz).

10. The resonator (70) of claim 6, wherein said coil (90) is comprised of copper.

11. The resonator (70) of claim 6, wherein said coil (90) is comprised of a plurality of generally circular coil segments (90*a*–90*n*), each of said coil segments having a polygonal cross section wherein flat surfaces (122) of adjacent coil segments face each other.

12. The resonator (70) of claim 11, wherein said polygonal cross section is generally rectangular, having dimensions of length x and width y, wherein dimension x defines said flat surfaces (122) of adjacent coil segments (90*a*–90*n*).

13. The resonator of claim 11, wherein said coil segments (90*a*–90*n*) are provided with a dual channel construction for providing the introduction of a coil cooling medium, comprising an inlet passageway (118) and an outlet passageway (120) having a separate inlet (100) and outlet (102), respectively, at said low-voltage end (94) of said coil, and wherein said inlet and outlet passageways (118, 120) are connected and in communication with each other at said high-voltage end (96) of said coil.

* * * * *